United States Patent [19]

Whitney

[11] 4,146,184

[45] Mar. 27, 1979

[54] SHREDDER WITH GRATE DOOR

[75] Inventor: Richard P. Whitney, East Moline, Ill.

[73] Assignee: Sivyer Steel Corporation, Milwaukee, Wis.

[21] Appl. No.: 847,846

[22] Filed: Nov. 2, 1977

Related U.S. Application Data

[63] Continuation-in-part of Ser. No. 725,031, Sep. 20, 1976, Pat. No. 4,061,277.

[51] Int. Cl.[2] ..... B02C 13/284

[52] U.S. Cl. ..... 241/73; 241/89.2; 241/186 R; 241/285 A

[58] Field of Search ..... 241/73, 86, 86.1, 87.1, 241/88, 88.1, 88.4, 89, 89.1, 89.2, 186 R, 186.2, 186.3, 189 R, 885 A, 885 B

[56] References Cited

U.S. PATENT DOCUMENTS

| | | | |
|---|---|---|---|
| 1,625,554 | 4/1927 | Liggett | 241/88.4 |
| 3,727,848 | 4/1973 | Francis | 241/197 |
| 3,891,152 | 6/1975 | Guggenheimer | 241/89.2 |
| 4,029,206 | 9/1977 | Konig et al. | 241/73 |
| 4,061,277 | 12/1977 | Whitney | 241/89.2 |

*Primary Examiner*—Howard N. Goldberg
*Attorney, Agent, or Firm*—Thad F. Kryshak

[57] ABSTRACT

A shredder for reducing scrap materials such as scrapped automobiles to pieces of a smaller size includes a shredder housing having an inlet and an outlet, rotary hammer means positioned in said housing, cutter means, and means for rotating said hammer means to co-act with said cutter means to reduce the material to smaller pieces. The outlet is closed by a door which contains a discharge grate through which shredded pieces must pass to leave the housing. The door is normally locked, but can be opened from the outside to permit unshreddables to be readily removed from the shredder and to replace the grate when necessary. In one embodiment the outlet is located in the end wall of said housing preferably about 180° from the inlet and the door contains a grate which is comprised of a plurality of grate segments.

5 Claims, 4 Drawing Figures

SHREDDER WITH GRATE DOOR

RELATED APPLICATIONS

This application is a continuation-in-part of my earlier copending application Ser. No. 725,031, filed Sept. 20, 1976, which issued on Dec. 6, 1977, as U.S. Pat. No. 4,061,277.

BACKGROUND OF THE INVENTION

There is a continuing need for improvements in shredders for reducing scrap metal materials, especially scrapped automobiles, into convenient size pieces for use in steel mills. Such shredders have been known for a long time but there are basic problems that have never been solved. One such problem is how to reduce the scrap metal material to the desired size pieces with a minimum consumption of energy. Another problem is how to reduce the downtime involved in removing unshreddables and replacing worn or broken components such as grates.

In the past, a variety of attempts have been made to solve these problems including designing shredders with more efficient and durable rotors and hammers and different shaped housings. However, such attempts have not been completely successful.

Representative of a type of shredder which is now widely used is that shown and described in the Newell U.S. Pat. No. 3,482,788. Although the performance of the Newell-type shredder can be improved by employing therein the improved four-arm rotor design and the protective arm caps shown in the Francis U.S. Pat. No. 3,727,848, the energy consumption of the Newell-type shredder is still higher than desired and the internal surfaces of the housing and the grate appear to wear excessively and unevenly. In addition, considerable downtime occurs when the shredder encounters an "unshreddable" object which must be removed or a grate becomes worn and must be replaced.

SUMMARY OF THE INVENTION

The shredder of the present invention comprises a shredder housing having an inlet and an outlet, rotary hammer means positioned within said housing, a cutter means, means for rotating said hammer means to co-act with the cutter means to reduce the scrap materials to smaller size pieces. The outlet is closed by a door which contains a discharge grate through which such pieces must pass to leave the housing. The door is normally locked, but can be opened to permit unshreddables to be readily removed and to replace the grate when necessary.

In the preferred embodiment, the outlet is located in the end wall of the housing about 180° from the inlet and the door which closes the outlet contains a grate which is comprised of a plurality of grate segments. The door is provided with an automatic opening and locking mechanism.

In addition, in the preferred embodiment, the openings in the grate of the door are orientated to approximate the angle at which the pieces leave the hammer path so that the pieces of shredded material the size of the grate openings or smaller will pass through the grate as soon as possible as opposed to striking the grate and being bounced back into the reach of the hammers and being repeatedly banged against the grate and other internal components. Less energy is consumed when the pieces of scrap material leave the shredder promptly upon reaching the desired size rather than being subject to repeated and unnessary hammering within the housing.

Positioning the outlet in the end wall of the housing approximately 180° from the normal inlet also has been found to have the beneficial effect of conserving energy and reducing wear on the internal surfaces of the housing and ultimately the wear on other components of the shredder. It has been discovered that in the conventional Newell-type shredder, once the pieces of scrap have obtained the desired size which will pass through the grate openings located in the top of the Newell machine, they attempt to leave the housing of the shredder at a point approximately 180° from the inlet, that is, at a point in the vertical end wall of the housing. Therefore, it is at this point that the outlet is preferably positioned.

The provision of a shredder with a door with a grate to close the outlet provides several significant advantages over conventional shredders. As previously described, the use of the door can significantly reduce the downtime normally involved in replacing the grate of a shredder. Presently, no one can predict exactly when a portion of the grate will wear to the point that the entire grate must be replaced, and as a result many times a grate is worn to the point where it must be replaced when a new one is not readily available. However, with the grate mounted in the door, the wear of the grate surface may be easily checked.

Furthermore, the door is preferably adapted to receive and hold a plurality of grate segments in place of a one piece grate. The use of grate segments makes possible significant savings in the cost of the grate material. For example, at times only one particular portion of the total grate wears excessively to the point that it can no longer be used even though the remaining portions of the grate are still usable. When this occurs with a conventional onepiece grate, the entire grate must be replaced or rebuilt. On the other hand, when this occurs in a shredder having a grate made up of several grate segments, only the segment which has been worn to the point requiring replacement has to be removed and replaced with a new segment.

One of the most bothersome problems for an owner of a conventional shredder is the expensive downtime which results when unshreddables are encountered in the shredding process. When an unshreddable is encountered in a conventional shredder the operation must be stopped and the shredder practically dismantled to remove the unshreddable object. The resulting downtime is expensive. The outlet door of the shredder of the present invention provides easy access to the interior of the shredder to remove the unshreddable and a quick resumption of shredding activity. It also provides a quick and easy way to check the internal components for damage.

The foregoing and other objects and advantages will appear from the following description. In that description, reference is made to the accompanying drawings which form a part thereof and in which there is shown by way of illustration and not of limitation a preferred embodiment of the invention.

DESCRIPTION OF THE PREFERRED EMBODIMENT

Referring to the accompanying drawings, the numeral 10 designates generally a shredder which has a rotary hammer assembly 11 mounted therein.

Figure 1:
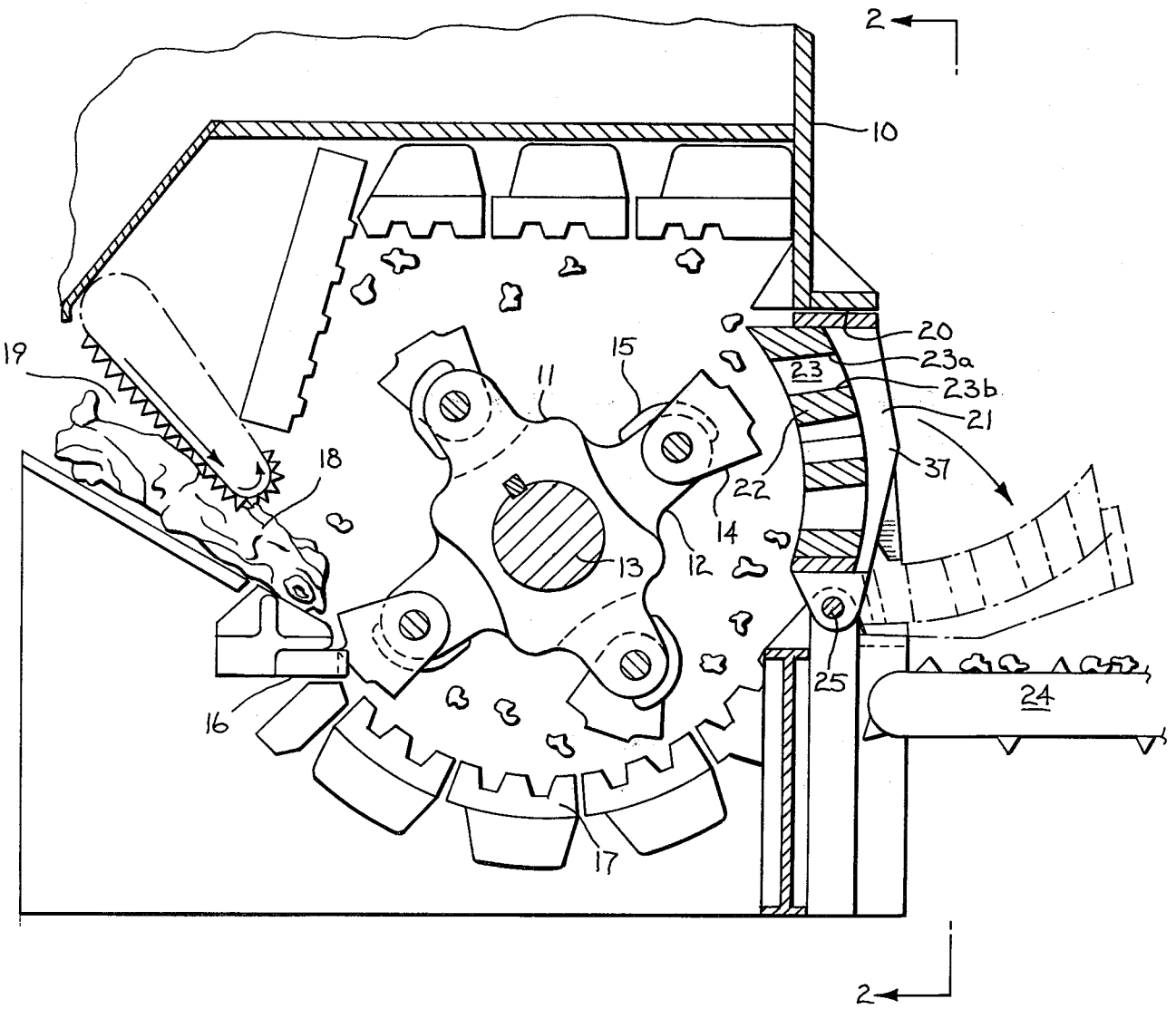
FIG. 1 is a view of a shredder embodying the present invention.

As seen in FIG. 1, the hammer assembly 11 comprises a series of four-arm spiders 12 mounted on and keyed to a shaft 13 which is journaled in bearings (not shown) that are structurally supported in the side walls of the shredder. As seen in FIG. 1, the hammers 14 are mounted on the ends of said spider arms 12 so that the hammers can freely swing and the ends of the arms of the spider are provided with the protective caps 15 described in the Francis U.S. Pat. No. 3,727,848.

The hammers 14 co-act with the teeth of a rigidly mounted cutting comb 16 that extends lengthwise of the hammer assembly and with cutter bars 17, that are circumferentially spaced about the lower part of the orbit of the hammers so as to break up any material 18 entering the shredder through the inlet 19. The pieces or fragments into which the shredder breaks the incoming materials leave the shredder housing through the outlet 20 which is closed by a door 21 containing a grate 22. The pieces are propelled through openings 23 in the grate 20 and drop onto a conveyor 24.

In this preferred embodiment, as seen in FIG. 1, the door outlet 20 is positioned in the end wall approximately 180° from the inlet which is the point the pieces of desired size attempt to leave the housing.

The outlet door assembly of the shredder of the present invention will now be described in detail.

In the drawings, it can be seen that the door 21 which closes the outlet 20 is attached to the shredder 10 by hinges 25. The hinges 25 permit the door to be swung from a closed position downwardly to an open position, seen in FIG. 1 in broken lines.

Figure 2:
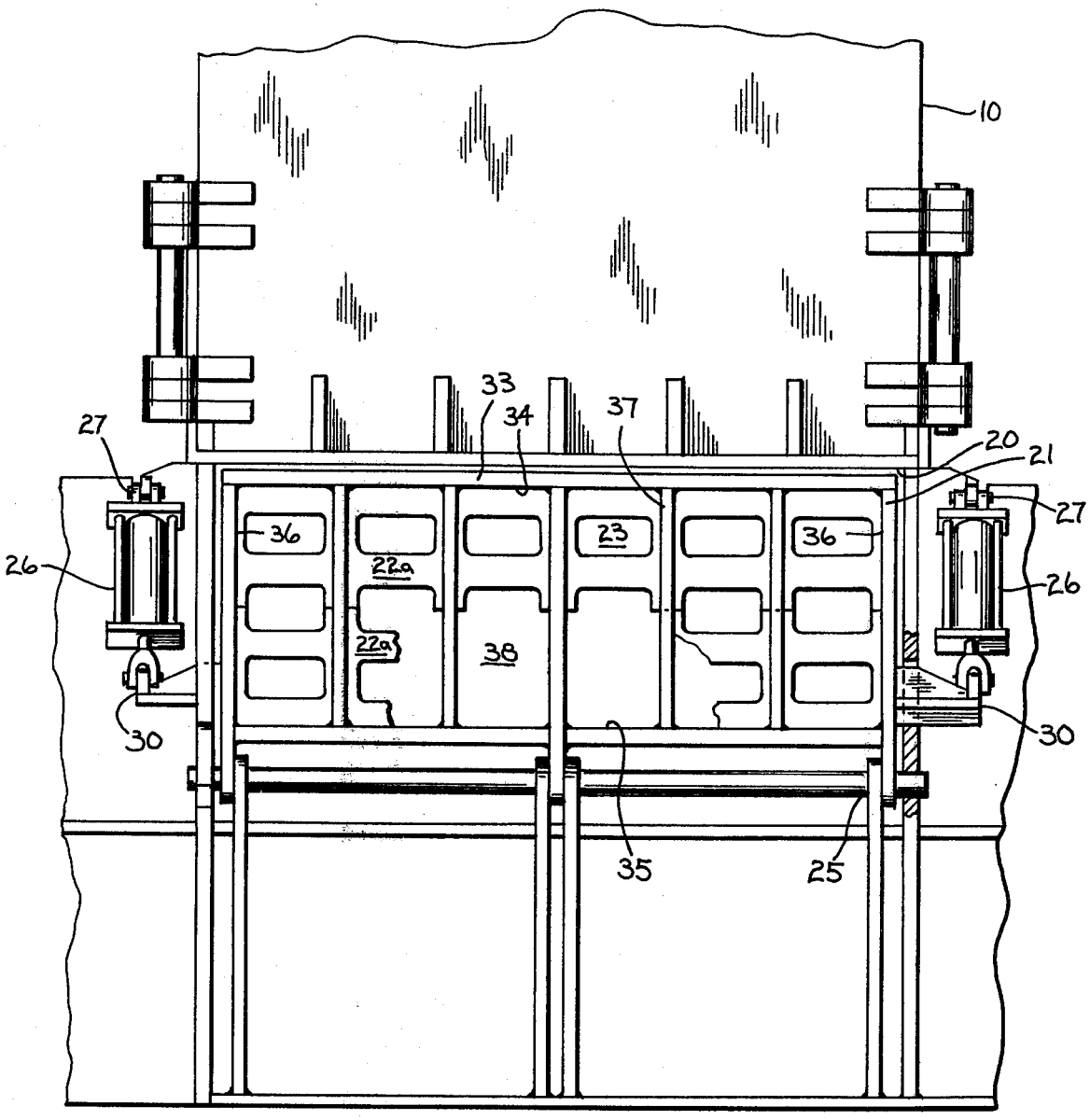
FIG. 2 is an elevational view partly in section, of the end wall of a shredder embodying the present invention.
Figure 3:
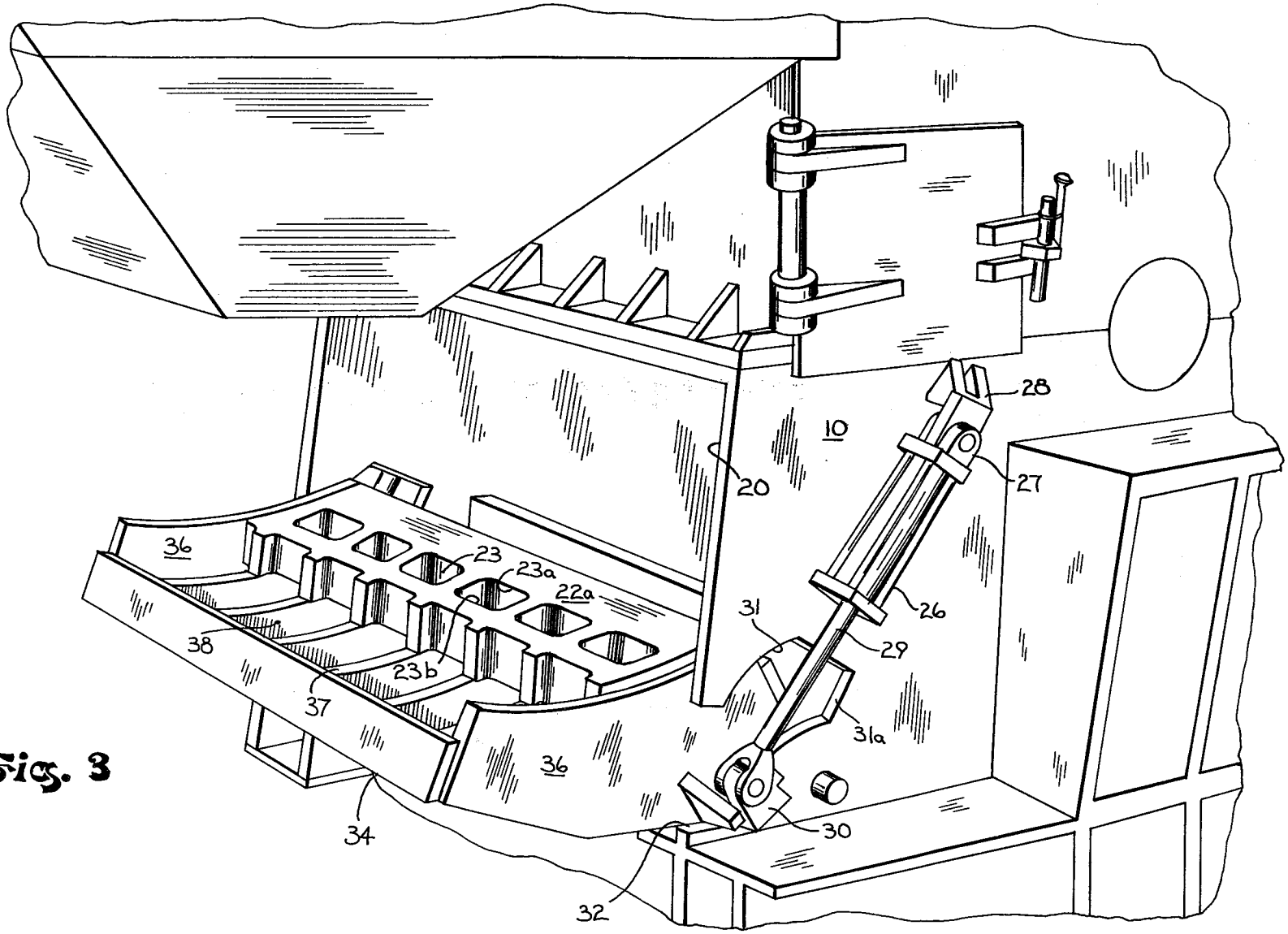
FIG. 3 is a perspective view of a side and the end wall of the shredder of FIG. 2 showing the outlet door open.
Figure 4:
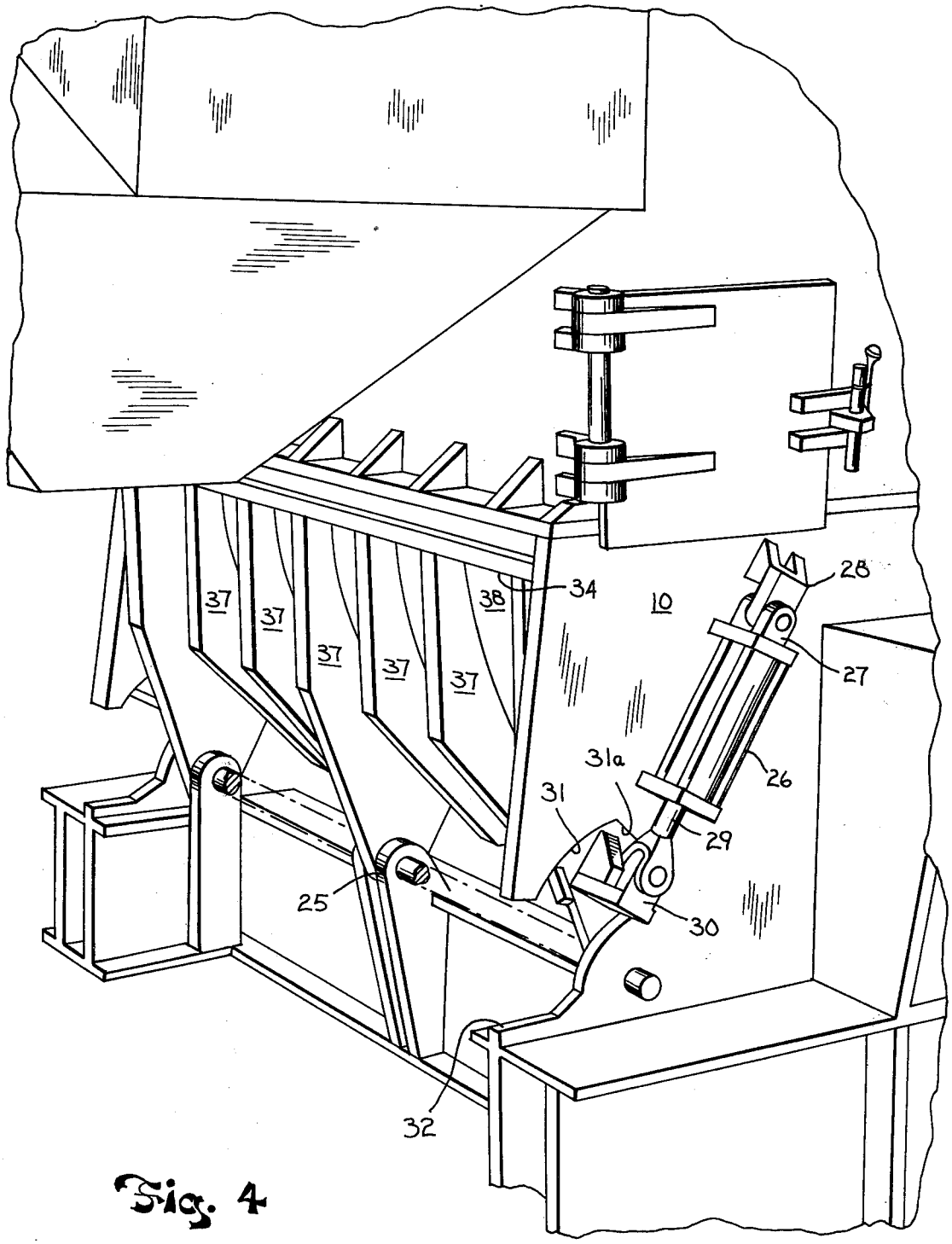
FIG. 4 is a perspective view of a side and the end wall of the shredder of FIG. 2 showing the outlet door closed.

In the embodiment seen in FIGS. 2 to 4, the door 21 is moved from a closed to an open position and from an open to a closed position by a pair of double acting linear type hydraulic motors 26. The base 27 of each of the motors 26 is anchored to a stub 28 on the side of the shredder 10 and the rod 29 is pivotally attached to a lug 30 on the door 21. When the hydraulic motors 26 are actuated and the piston rods 29 extend the door 21 is opened and when the piston rods 29 retracted fully the door 21 is closed. As the door 21 opens and closes the lugs 30 are guided in their travel in arcuate slots 31 in the side walls of the shredder 10 thereby insuring a smooth even movement of the door. The closed ends 31*a* of the slots 31 are shaped to mate with the lugs 30 as seen in FIG. 4 so that the door 21 can be tightly closed. When the door 21 is fully opened as seen best in FIG. 3, the weight of the door 21 is mainly supported by the extension 32 of the wall of the shredder 10 housing so that the entire weight of the door 21 is not supported by the hinges 25 and hydraulic motors 26.

In the drawings, especially FIGS. 2, 3 and 4, it can be seen that the door 21 includes a frame 33 having a top section 34, a bottom 35 and side walls 36, 36. The top 34 and the bottom 35 are joined by a series of ribs 37 which extend between the top 34 and the bottom 35. As seen best in FIG. 2, the grate 22 is positioned in the door so that the openings 23 are positioned in the open spaces 38 between the ribs 37 so that pieces passing through the openings 23 will leave the shredder housing.

In a preferred embodiment the hydraulic motors 26 are controlled automatically or by the operator of the shredder by a conventional control circuit which when activated conveys hydraulic fluid to the two hydraulic motors. Control circuits suitable for use in the invention are well known to the art.

Although, in most instances, the hydraulic motors 26 will hold the grate in a closed position, in some circumstances it may be desirable to provide a separate locking mechanism, such as a hydraulic motor which controls a latch.

Returning to FIG. 1, it can be seen that in the preferred embodiment of the grate, the top wall 23*a* and the bottom wall 23*b* of each of the openings 23 in the grate 22 are oriented at an angle which deviates from the horizontal. The angle of deviation selected is one which permits the largest number of pieces of desired size to leave the housing at the grate location. In the preferred practice, when the grate is positioned in the end wall at about 180° from the inlet, the angle is about 10°-50° above the horizontal. However, the angle will vary depending upon where the grate is located.

Returning to FIGS. 2 and 3, it can be seen that the preferred grate 22 is made up of a plurality of segments 22*a*. Although, in the drawing, the grate 22 is shown as being comprised of a pair of segments 22*a*, each of which extends from one side wall 36 of the door to the other; in other embodiments, it may be desirable to employ a grate 22 made up of a plurality of segments 22*a* in which the segments extend from top wall 34 to bottom wall 35 of the door and a plurality of segments 22*a* join together to extend from side wall 36 to side wall 36 of the door 21.

It will be apparent to those skilled in the art that the provision of the shredder with a door which contains a grate closing the outlet of the shredder provides significant advantages over the conventional shredder structures. As previously indicated, the use of the door assembly significantly reduces the downtime normally involved in replacing the grate or removing unshreddables from within the shredder housing as the conventional shredders have no convenient means by which an operator can check the wear of the grate, the wear of the hammers or the other components. With the shredder of the present invention, each of these acts can be performed without the operator having to actually enter the interior of the housing, thus, expensive downtime is drastically reduced.

It will also be readily apparent to those skilled in the art that a number of modifications and changes may be made without departing from the spirit and scope of the present invention. For example, in some instances it may be desirable to replace the hydraulic motor 26 with electric motors or mechanical structures.

While for purposes of illustration, a preferred embodiment has been described, it will be understood that other variations and changes may be made without departing from the spirit and scope of the present invention.

I claim:

1. In a shredder for reducing scrap materials to pieces of a smaller size which shredder includes a housing having an inlet and an outlet, rotary hammer means positioned in said housing, cutter means, means for rotating said hammer means to co-act with the cutter means to reduce the scrap material to pieces of a smaller size and a grate closing the outlet having openings through which the shredded pieces must pass to leave the housing, the improvement which comprises a door hingedly connected to the shredder so that it can be swung open and closed, said door including a grate retaining frame having a top piece, a bottom piece and two side pieces, and at least one rib extending between the top and bottom pieces, said grate being positioned in said frame so that the openings in the grate are positioned on either side of the rib, said door being openable from the outside to permit the readily replacement of the grate.

2. The shredder of claim 1 in which the grate is comprised of a plurality of grate segments.

3. The shredder of claim 1 in which the door is provided with a pair of lugs that are adapted to fit in and travel through guide means on the shredder to insure a smooth opening and closing of the door.

4. A door assembly for a shredder, said door including a grate retaining frame adapted to be hingedly connected to the shredder so that it can be swung open and closed, said frame having a top piece, a bottom piece and two side pieces, and at least one rib extending between the top and bottom pieces, and a grate positioned in said frame so that the openings in the grate are positioned on either side of the rib.

5. The shredder of claim 4 in which the door is provided with a pair of lugs that are adapted to fit in and travel through guide means on the shredder to insure a smooth opening and closing of the door.

* * * * *